US012065743B1

(12) United States Patent
Agarwal et al.

(10) Patent No.: US 12,065,743 B1
(45) Date of Patent: Aug. 20, 2024

(54) COLD SPRAY DEPOSITION OF LUNAR REGOLITH SIMULANT-CONTAINING COATINGS FOR SPACE REPAIR APPLICATIONS

(71) Applicants: Arvind Agarwal, Miami, FL (US); Denny John, Miami, FL (US); Cheng Zhang, Miami, FL (US)

(72) Inventors: Arvind Agarwal, Miami, FL (US); Denny John, Miami, FL (US); Cheng Zhang, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 18/329,095

(22) Filed: Jun. 5, 2023

(51) Int. Cl.
*C23C 24/04* (2006.01)

(52) U.S. Cl.
CPC ..... *C23C 24/04* (2013.01)

(58) Field of Classification Search
CPC ..... C23C 24/04
See application file for complete search history.

(56) References Cited

PUBLICATIONS

Philipp Nieke et al., Manufacturing Dense Thick Films of Lunar Regolith Simulant EAC-1 at Room Temperature, Materials 2019, 12, 487, 11 pages.
Vamsi Krishna Balla et al., First demonstration on direct laser fabrication of lunar regolith parts, Rapid Prototyping Journal 18/6 (2012) pp. 451-457.
Eric J. Faierson et al., Potential ISRU of Lunar Regolith for Planetary Habitation Applications, Moon, 2012, 34 pages.
Paul Fuierer et al., Dense, nano-grained, multi-phase ceramic coatings by dry aerosol deposition of lunar regolith simulant, Additive Manufacturing 35 (2020), 10 pages.

*Primary Examiner* — Adam Krupicka
(74) *Attorney, Agent, or Firm* — Saliwanchik, Lloyd & Eisenschenk

(57) ABSTRACT

Provided is a method of repairing structures on the Lunar surface using Lunar regolith containing metallic coatings. An ultra-portable and low-pressure cold spray system is utilized to consolidate coatings. This system can be easily transported to space, reducing the payload. Lunar regolith is added to the metal powder before cold spray deposition. Lunar regolith increases the tampering effect during cold spray deposition, thereby causing severe plastic deformation of the metal powders and providing a coating with high quality and minimum porosity. The presence of Lunar regolith increases the hardness of the coating and improves wear properties. Coatings on a large area can be made rapidly without much surface preparation. These coatings can be rapidly applied to various Lunar structures to repair, reinforce, and restore (RRR) functionality and performance in the Lunar environment.

20 Claims, 7 Drawing Sheets

Lunar Regolith: Aluminum/Zinc Mixture – 1:4 Ratio

Lunar Regolith: Aluminum/Zinc Mixture – 1:4 Ratio

COLD SPRAY DEPOSITION OF LUNAR REGOLITH SIMULANT-CONTAINING COATINGS FOR SPACE REPAIR APPLICATIONS

BACKGROUND

During space exploration, the structural components and rovers are subjected to severe environmental conditions such as thermal cycles, high vacuum, and abrasive interactions stemming from the Lunar dust. These extreme environmental conditions degrade aerospace structures and reduce their life. In order to prolong their life and performance, it is possible to repair these structures instead of replacing the component as a whole. Onsite repairs of these Lunar structures using resources available on the Moon will save dependency on the Earth's resources and provide better utilization of Lunar resources. To repair these structures, Lunar regolith containing metallic coatings can be deposited using a low-pressure portable cold spray system.

Most high-pressure cold spray systems need more than 500 sq. ft. of the booth area, gas supplies, power greater than 400 V, and other supplementary resources. Additionally, for consolidating highly ductile pure aluminum coatings, these machines use temperatures above 400° C., pressures above 15 bar, and a supply of nitrogen gas. Consequently, these machines are difficult to transport and install in space since they increase the payload and utilize larger space. Alternatively, cold spray systems that work under low pressures of less than 8 bar and air as carrier gas are ultra-portable and compact, easily transported to the Lunar environment, reducing the payload.

BRIEF SUMMARY

Embodiments of the subject invention provide systems and methods adding Lunar regolith to a metal powder to make quality coatings with portable cold spray systems. Lunar regolith is abundantly available on the Lunar surface. Embodiments provide an ultra-portable cold spray system to consolidate high-quality metallic coatings reinforced with Lunar regolith for onsite repair of Lunar structures. According to an embodiment of the subject invention, hard Lunar regolith ceramic powders can be mixed with ductile metallic powders. During cold spraying, when Lunar regolith ceramic particles travel at supersonic velocities and impact the ductile metallic particles, it leads to increased plastic deformation at the substrate. This phenomenon is called the tampering effect. By increasing the tampering effect during cold spray, it induces severe plastic deformation, thus providing high-quality coatings. Lunar regolith-contained coatings can be applied to the Lunar structures to repair, reinforce, and restore functionality. The coatings thus manufactured have enhanced wear resistance and better hardness, delivering long-term protection to the structural components. The use of Lunar regolith as a consumable for repair significantly contributes to the vision of in-situ resource utilization in the Lunar environment.

BRIEF DESCRIPTION OF DRAWINGS

(FIG. 2A) 1:4 ratio coating with a thickness of 0.7 to 1 mm (FIG. 2B) 4:1 ratio coating with a 200 μm thickness (FIG. 2C) 9:1 ratio coating with a 15 μm thickness (FIG. 2D) 10:0 ratio coating (only Lunar regolith) which is a discontinuous coating of 5 μm thickness. There is no direct established relationship between coating thickness and weight ratio, however as the quantity of the metal powder increases correspondingly it helps to make thicker coatings if sprayed for longer hours.

DETAILED DESCRIPTION

Embodiments of the subject invention provide systems and methods that utilize an existing ultra-portable cold spray that operates with low pressures (e.g., a low pressure portable cold spray system operating below 8 bar) for producing Lunar regolith containing metal coatings for repair activities on the Lunar surface. The numerous advantages of the ultra-portable cold spray and Lunar regolith-containing metallic coating over the current state-of-the-art include: (i) High portability and the compact size of the cold spray enable easy transportation of the equipment from Earth to the Moon. In addition, the portable cold spray can be operated in confined spaces manually for repairing and restoring structures in the Lunar environment. One cold spray machine that has been used with certain embodiments is a Dymet Cold Spray Machine 108.2 (Estonia) which works with compressed air, a temperature ranging from room temperature (e.g., 25° C.) to 650° C. and a pressure less than 8 bar and a powder feed rate around 0.5 to 0.6 g/s (ii) Adding Lunar regolith in the metal powders with varying weight ratios of the powder (e.g., 4:1, 1:4) aids in making thick and dense coatings with improved hardness and wear resistance. As the ratio of the ductile powder increases, it helps to make thick deposits (e.g., 1 mm thick deposit achieved with 1:4 weight ratio as compared to 15 μm discontinuous coating obtained with 10:0 ratio). In addition, the increase in the wear resistance is observed as a reduction in the coefficient of friction value, 0.8 in the coating as compared to 0.9 in the aluminum substrate. (iii) Using a portable cold spray, scalable coatings can be made on large surfaces (>1 $m^2$) of the structures in the Lunar environment hence helping in scalable repair activities (e.g. Lunar rovers). (iv) The high-velocity impact of the particles (e.g., 300 to 400 $ms^{-1}$) in the cold spray enables the elimination of surface pretreatments such as blasting, polishing, and preheating.

Figure 1:
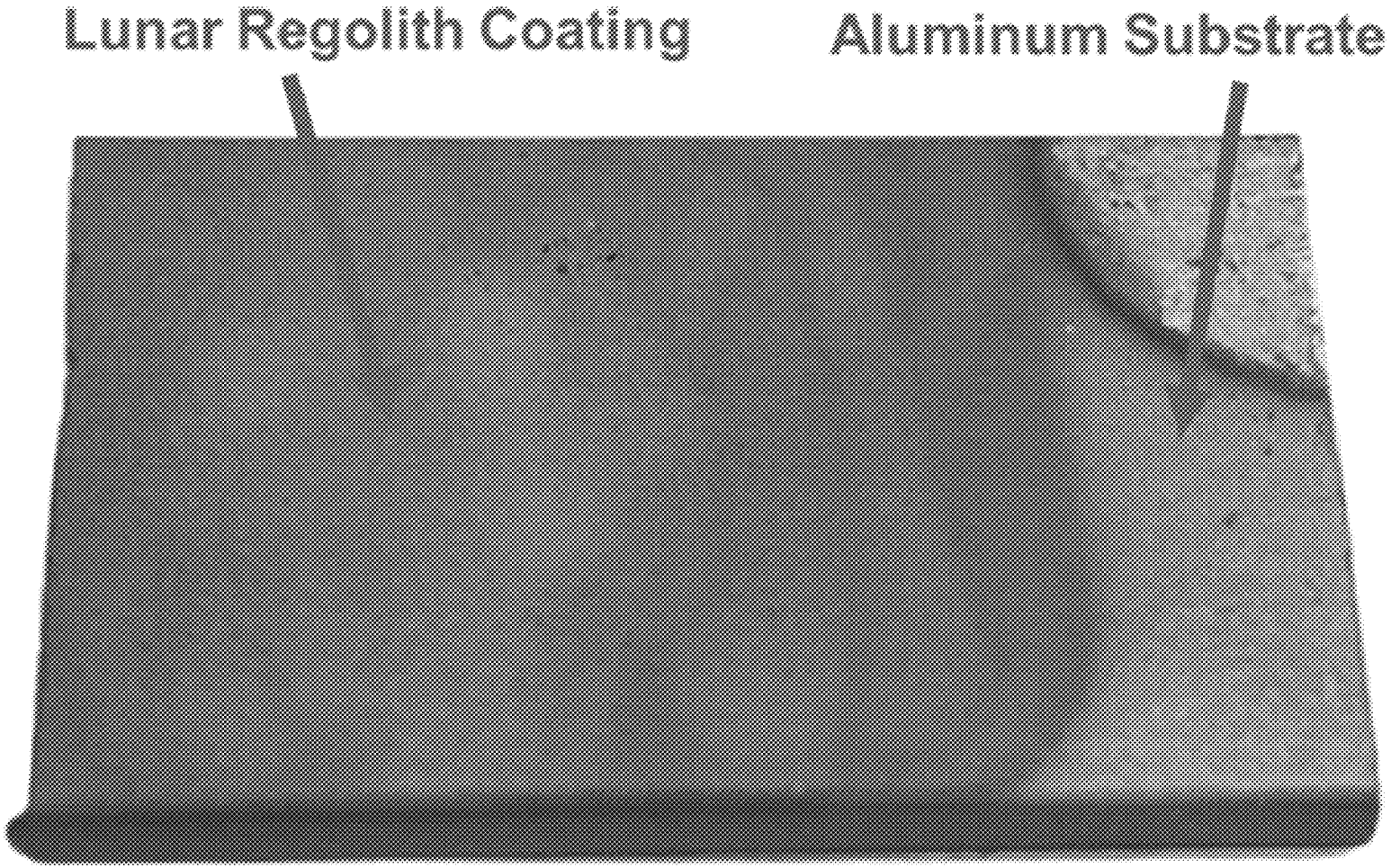
FIG. 1 is an image of Lunar regolith (Greenland)—aluminum/zinc mixture coating cold spray deposited on an aluminum (Al 6061-T6) substrate according to an embodiment of the subject invention. The dark grey side shows the coating, and the light grey side shows the bare substrate. For cold spray deposition, air is used as the carrier gas (e.g., with a temperature of 380° C., and pressure of 6 bar.) The Lunar regolith simulant, Greenland, is provided by NASA. A/Zn is procured as a commercially available powder.
Figure 2A:
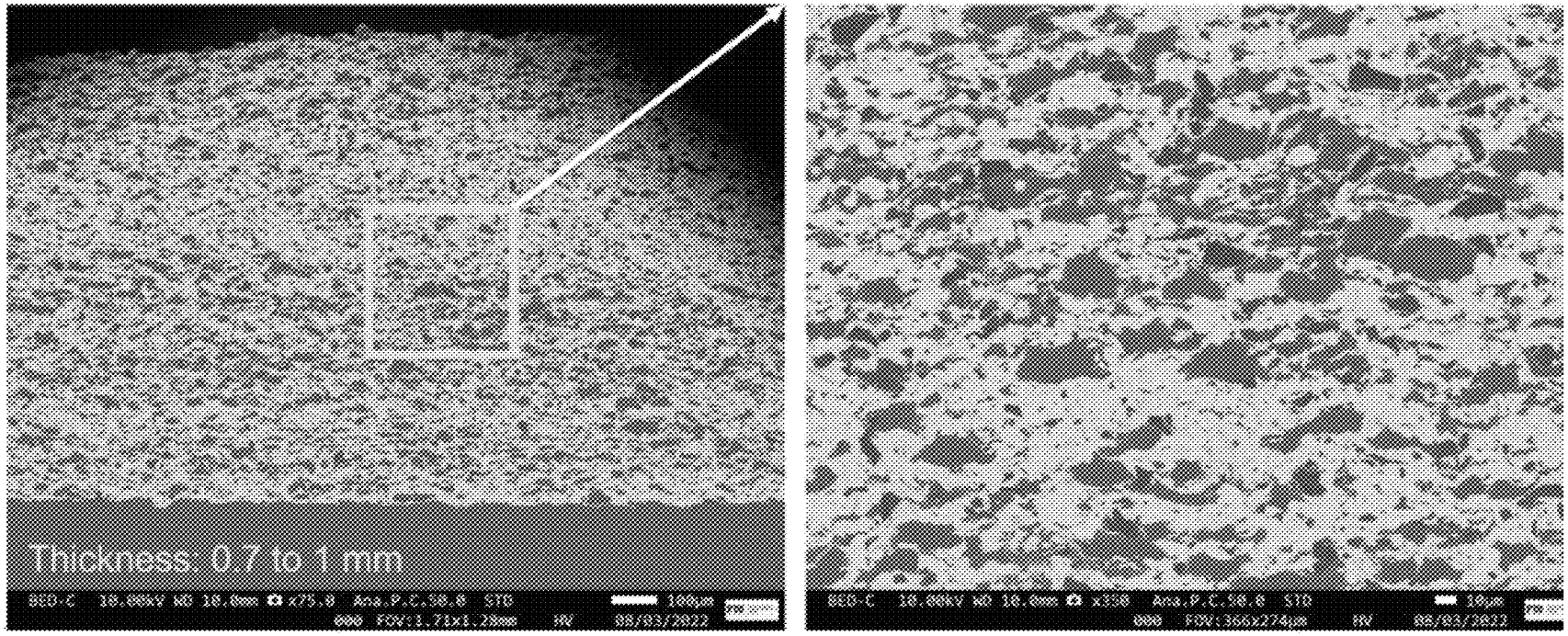
FIGS. 2A-2D are images of Lunar regolith (Greenland)—aluminum/zinc mixture coatings mixed in different dry weight ratios and sprayed by using an ultra-portable cold spray machine according to an embodiment of the subject invention. For example, a weight ratio of 1:4 means 20 g of lunar regolith mixed in 80 g of aluminum/zinc powder.
Figure 2B:
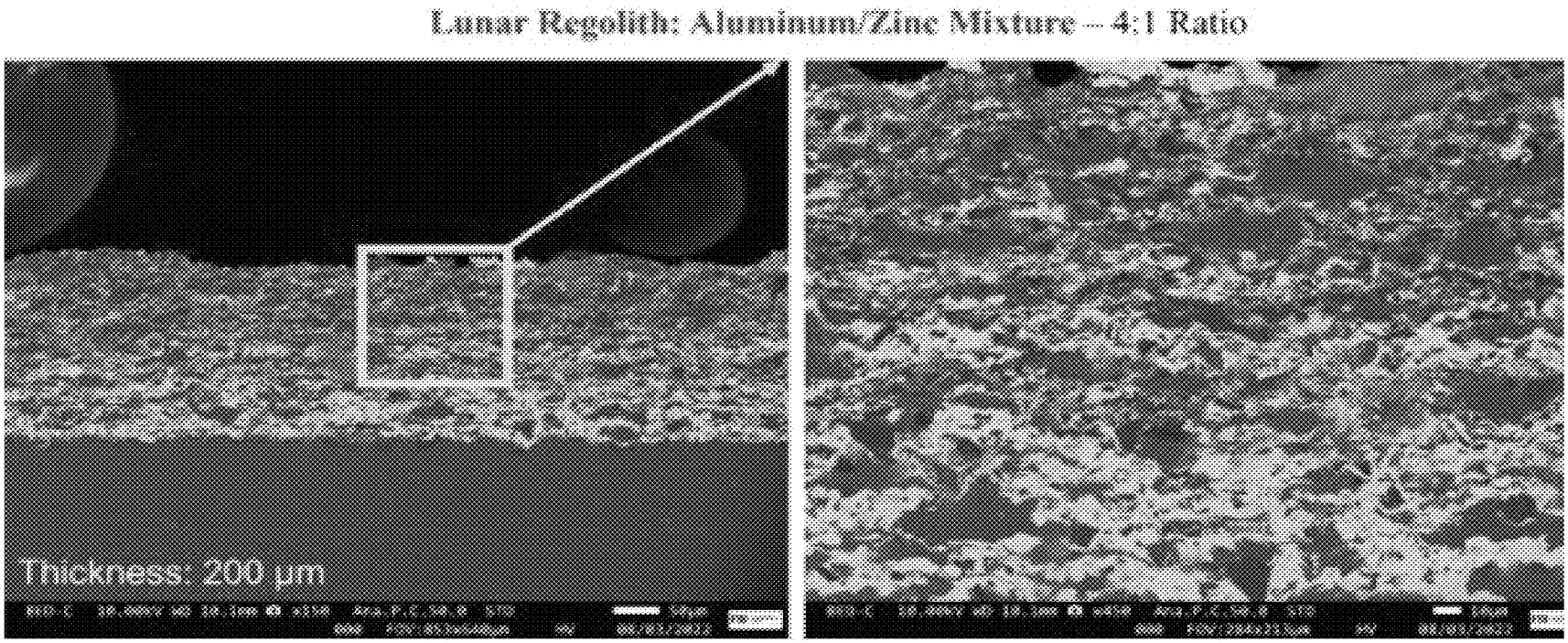
Figure 2C:
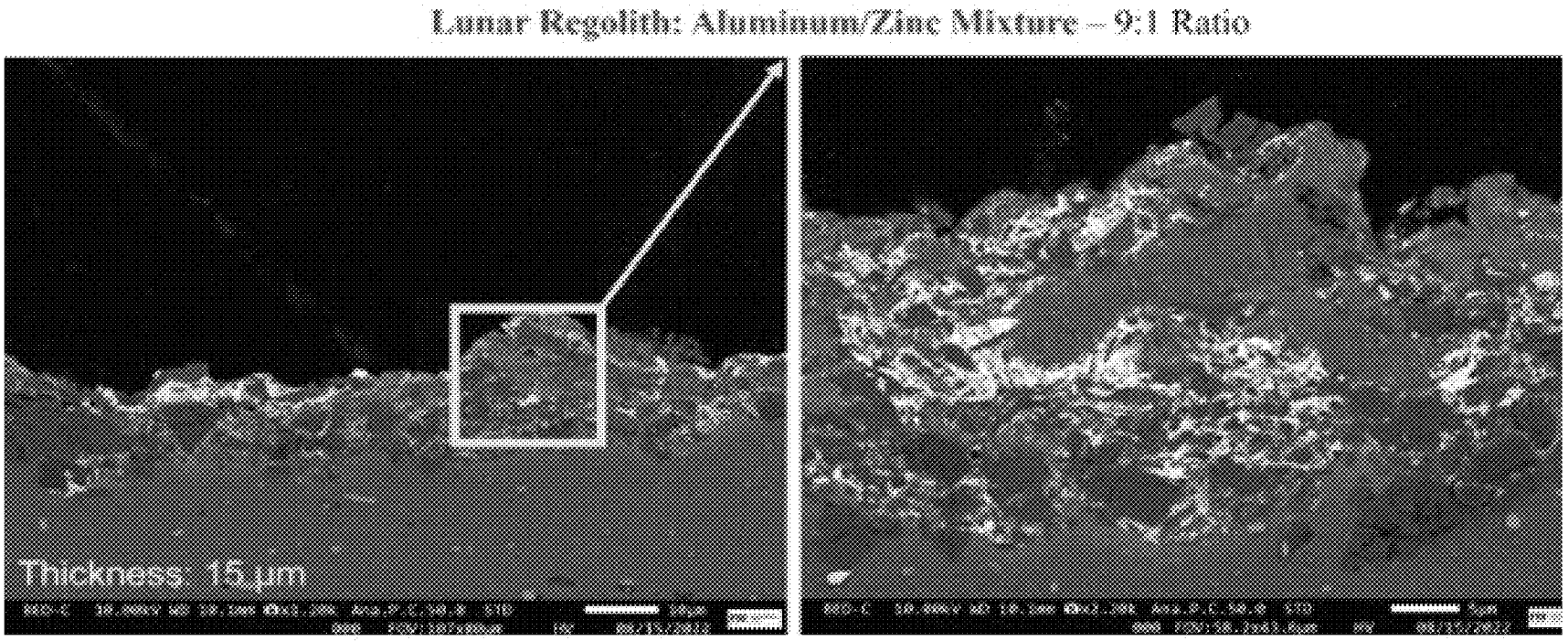
Figure 2D:
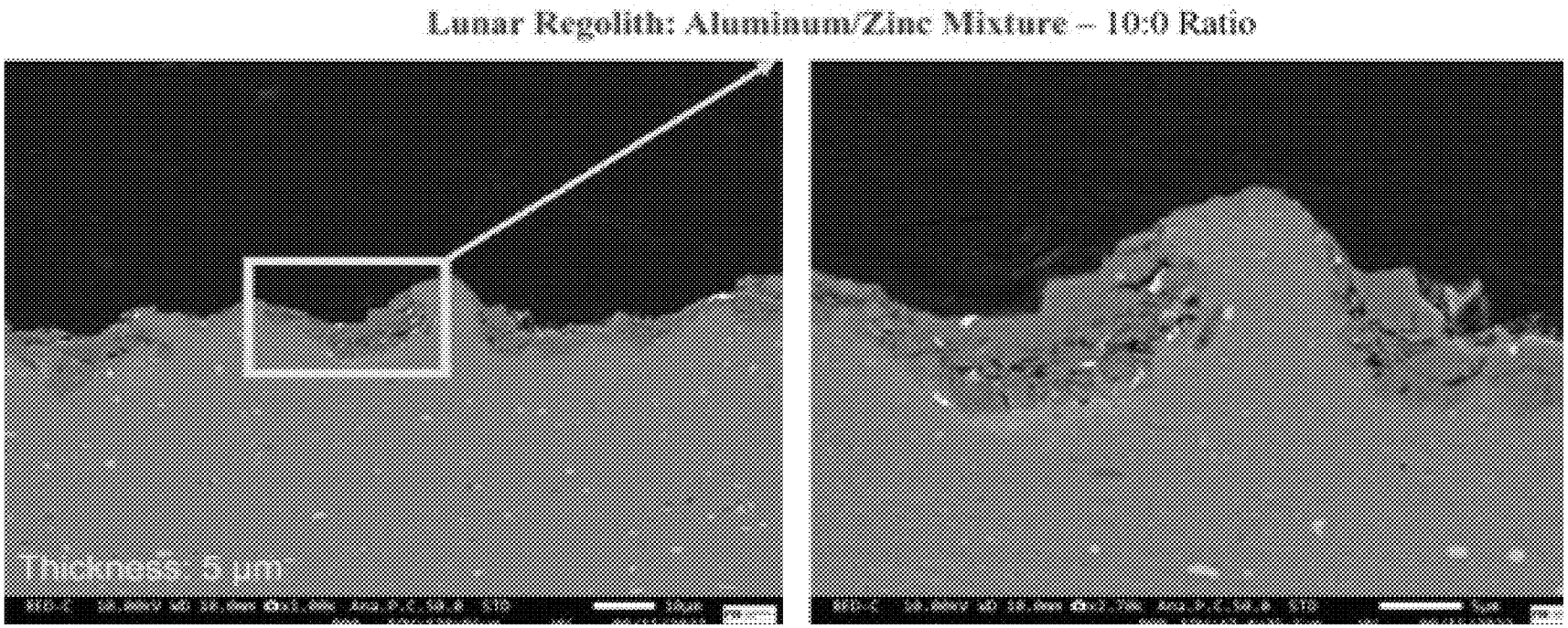
Figure 3:
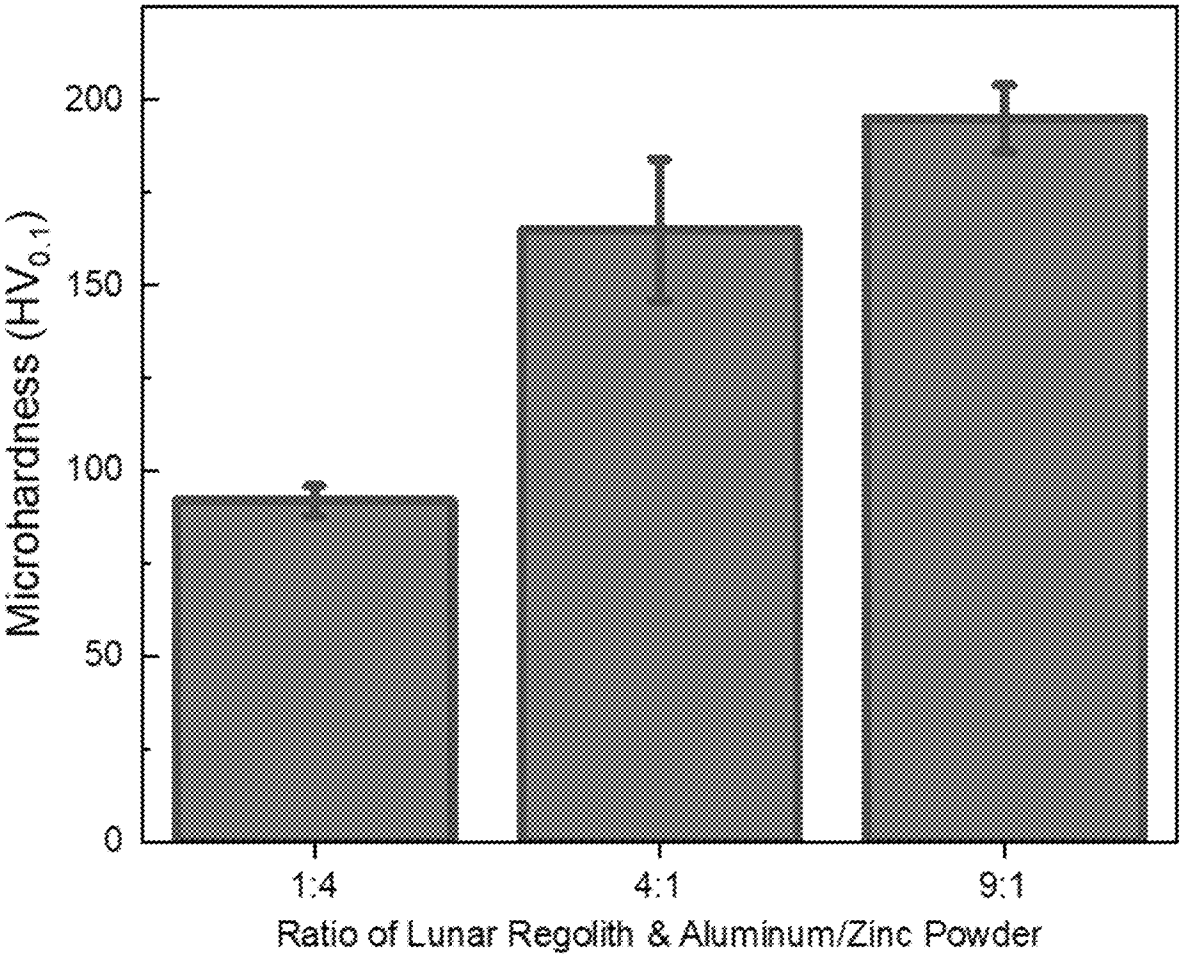
FIG. 3 is a chart showing the microhardness of the Lunar regolith—aluminum/zinc mixture coating for different weight ratio according to an embodiment of the subject invention. The hardness of the deposit can be tuned by selecting different weight ratio due to the hardness difference in both the lunar regolith simulant and aluminum/zinc powders. The microhardness of the deposit is calculated by using a load of 100 gf and a dwell time of 15 seconds. The coating parameters, substrate and powders used for cold spray deposition are as described with respect to FIG. 1, above.

Embodiments advantageously provide (a) Dense metallic coating (e.g., density nearly 99.9%) by adding Lunar regolith reinforcements with a seamless interface between the coating and the underlying substrate (FIGS. 2A-2D) to repair metallic structures on the Moon. Strong interface is manifested as an interface devoid of any cracks or delamination observable between the coating and the substrate (b) Wear resistant Lunar regolith-metallic coating on metallic surfaces such as aluminum and titanium (FIGS. 1 & 4) in the Lunar environment. (c) Tailored thickness from thin (e.g., 5 μm) coatings to thick (e.g., 1 mm) deposits with varying hardness (e.g., from 94 HV to 200 HV) depending on the ratio of Lunar regolith:metal powder mixture (e.g. 1:4 and 9:1) (FIGS. 2 & 3). (d) Ability to make large and scalable coatings in meter scale in the Lunar environment by utilizing the ultra-portability of the cold spray system.

Embodiments provide Lunar regolith containing metal coatings deposited using an ultra-portable cold spray system for onsite repairs of the Lunar structure. In certain embodiments, the metal coating exhibits a highly dense microstructure (e.g., up to 99.9% density), good bonding with the substrate (e.g., no cracks and no delamination were found), superior hardness (e.g., 94 to 200 HV, as compared to the hardness of pure aluminum, 35 HV, and zinc, 100 HV), and wear resistance (e.g., coefficient of friction 0.8 as compared to the 0.9 of the aluminum substrate). This method can be implemented on the Moon, significantly contributing to the repairing, reinforcing, and restoring of the Lunar structure by in situ utilization of the Lunar regolith.

One embodiment for reproducing the technology for manufacturing dense Lunar regolith—metal powder coating by using cold spray includes preparation and cold spray steps:

1. Preparation of Feedstock Powder for Cold Spray Deposition

Any ductile metal powder, either pure or an alloy, compatible with the parent material of the structure which plastically deforms during cold spray can be used for making coatings (e.g., certain powders with a hardness less than 160 HV (e.g., Ti) can be considered as ductile). A particle size range of 10 to 60 μm can be beneficially applied for cold spray deposition. Mix the metal powder (e.g., Al, Cu, and/or Ti) and the Lunar regolith or simulant (e.g., Greenland, Zircon, or JSC 1A) in the required ratio in a container to obtain a uniform powder mixture. The powder can be mixed by shaking, or by milling techniques such as ball or cryomilling. The ratio can be selected according to the thickness and properties desired in the final coating. If the thickness of the coating must be increased beyond 1 mm, more metal powder can be added compared to the Lunar regolith.

2. Cold Spray Deposition

Select the suitable air pressure (e.g., <8 bar), air temperature (e.g., room temperature or 25° C. to 650° C.), and powder feed rate for the deposition of the powder mixture depending upon the critical velocity of metal (e.g., aluminum, 640 ms-1). Then, deposit the powder mixture onto the structure or substrate (e.g. aluminum) to be coated using the portable cold spray system. Advantageously, in many embodiments, no surface preparation is required before cold spray deposition.

Embodiments provide cold sprayed Lunar regolith-metal powder plasma spray coatings and blasting testing for Lunar architectures contributing to the NASA Artemis mission. Embodiments provide advantageous and unique benefits with both Lunar simulants and native Lunar regolith. Certain embodiments can provide, utilize, enhance, or contribute to portable cold spray systems and their ability to make coatings.

Embodiments contribute to NASA's in situ resource utilization mission, including systems and methods to cold spray metal powders mixed with Lunar regolith with different ratios to produce beneficial results spanning from thin coatings to bulk deposits.

Figure 4:
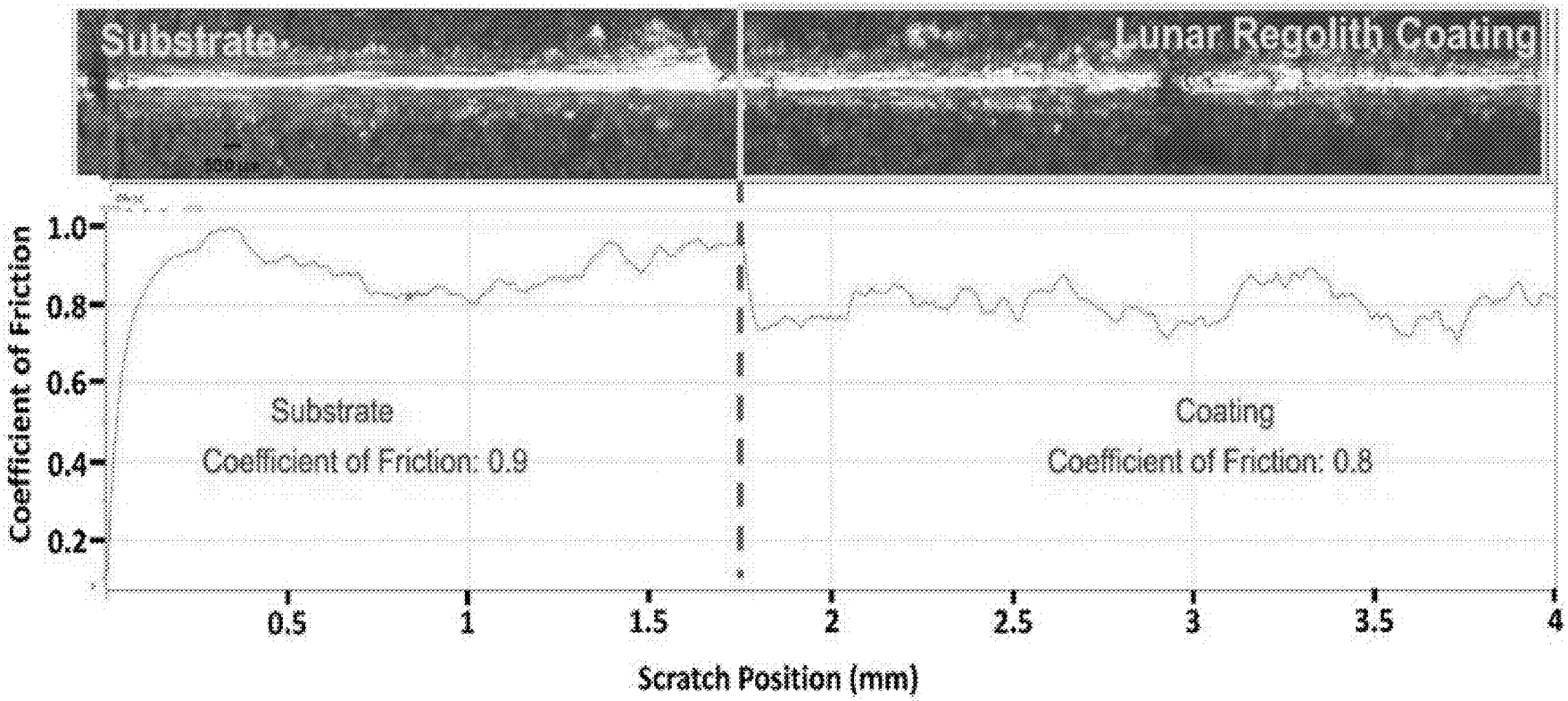
FIG. 4 is a chart with photographic overlay illustrating how scratch testing was performed to elicit the wear resistance according to an embodiment of the subject invention including a Lunar regolith:aluminum/zinc (4:1) coating at a constant scratch load of 10 N and scratch length of 4 mm. Revetest scratch tester (Anton Paar, RST3) equipped with a spherical Rockwell indenter of 50 μm diameter is used for performing the scratch testing. The coefficient of friction response and the superimposed optical image of the scratch shows the variation of wear properties across the substrate, interface, and coating. The Lunar regolith-coated region has a lower COF (0.8) than the substrate, which has a higher COF (0.9), indicating an improvement in the wear damage of the coated surface. The coating parameters, substrate and powders used for cold spray deposition are as described with respect to FIG. 1, above.

Embodiments have provided different coatings of Lunar regolith mixed with metal powder that have been cold sprayed. The microstructure of the developed coatings in certain embodiments has been investigated. The results demonstrate thick coatings/deposits can be cold sprayed (FIG. 2). Further, the wear behavior has been studied, which demonstrates better performance of the Lunar regolith contained metal coating to the underlying surface of the substrate (FIG. 4). The provided coatings can be applied for repairing Lunar structures in space.

Embodiments of the subject invention can provide high-quality metal-Lunar regolith mixture coatings for onsite repair of rovers and aerospace vehicles to restore their functionality and performance by using portable cold spray. Embodiments enable and improve a novel manufacturing paradigm to accelerate the usage of resources available on the Lunar surface. The provided coatings can fight against degradation from the harmful effects of Lunar dust. Thus, the provided systems and methods can be implemented for onsite repair activities of astronomical and Lunar vehicles.

Within the scope of the subject invention, it is contemplated that using additive manufacturing technology, complex near-net metal-Lunar regolith parts can be 3D printed in the Lunar environment. This will help create tools, parts, and habitats out of resources available in the Lunar environment saving the number of materials transported to the Moon and the overall cost of the process.

When ranges are used herein, such as for dose ranges, combinations and subcombinations of ranges (e.g., subranges within the disclosed range), specific embodiments therein are intended to be explicitly included. When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to embodiments of the invention.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A method for cold spray deposition of lunar regolith containing coatings for space repair applications, the method comprising:

a) providing a metal substrate suitable for receiving a cold spray deposition coating;

b) providing a metal powder suitable for application to the metal substrate via cold spray deposition coating;

c) mixing the metal powder with a Lunar regolith in a ratio of at least 1 part Lunar regolith to 4 parts metal powder to create a powder mixture; and d) depositing the powder mixture onto the metal substrate using a low pressure portable cold spray system.

2. The method according to claim 1, further defined by the metal powder comprising a ductile metal powder that plastically deforms during cold spray deposition.

3. The method according to claim 2, further defined by the metal powder comprising at least one metal selected from the list consisting of aluminum, copper, and titanium.

4. The method according to claim 3, the metal powder comprising exactly one metal selected from the list consisting of aluminum, copper, and titanium.

5. The method according to claim 2, the Lunar regolith comprising at least one of a native Lunar regolith or a Lunar regolith simulant.

6. The method according to claim 5, the Lunar regolith comprising a Lunar regolith simulant.

7. The method according to claim 6, the Lunar regolith comprising Greenland Lunar regolith.

8. The method according to claim 7, the Lunar regolith consisting essentially of Greenland Lunar regolith.

9. The method according to claim 6, the portable cold spray system being a low pressure portable cold spray system that works with a compressed air gas pressure less than 8 bar.

10. The method according to claim 9, the step of depositing the powder mixture onto the metal substrate comprising depositing the powder mixture at an air pressure in a range of from 6 to 8 bar.

11. The method according to claim 9, the step of depositing the powder mixture onto the metal substrate comprising depositing the powder mixture at an air temperature in a range of from 25° C. to 650° ° C.

12. The method according to claim 9, the step of depositing the powder mixture onto the metal substrate comprising depositing the powder mixture at a powder feed rate in a range of from 0.5 to 0.6 g/s.

13. The method according to claim 9, the step of depositing the powder mixture onto the metal substrate comprising depositing the powder mixture at an air pressure in a range of from 6 to 8 bar, an air temperature in a range of from 25° C. to 650° C., and a powder feed rate in a range of from 0.5 to 0.6 $gs^{-1}$.

14. The method according to claim 13, the metal powder being mixed with the Lunar regolith in a ratio of at least 4 parts Lunar regolith to 1 part metal powder to create the powder mixture, and the step of depositing the powder mixture onto the metal substrate comprising forming a coating layer with a thickness in a range of from 15 μm to 1 mm.

15. A cold spray deposition coated construct for space repair applications, the cold spray deposition coated construct comprising:

a metal substrate; and a cold spray deposition coating on an outer surface of the metal substrate, the cold spray deposition coating comprising a ductile metal powder mixed with a Lunar regolith in a ratio of at least 1 part Lunar regolith to 4 parts ductile metal powder.

16. The coated construct according to claim 15, the metal powder comprising at least one metal selected from the group consisting of aluminum, copper, and titanium.

17. The coated construct according to claim 16, the Lunar regolith comprising at least one of a native Lunar regolith or a Lunar regolith simulant.

18. The coated construct according to claim 17, the coating layer having an average layer thickness in a range of from 15 μm to 1 mm.

19. A method for cold spray deposition of lunar regolith containing coatings for space repair applications, the method comprising:

a) providing a metal substrate suitable for receiving a cold spray deposition coating;

b) providing a metal powder suitable for application to the metal substrate via cold spray deposition coating;

c) mixing the metal powder with a Lunar regolith in a ratio of at least 4 parts Lunar regolith to 1 part metal powder to create a powder mixture; and d) depositing the powder mixture onto the metal substrate using a portable cold spray system;

the metal powder comprising a ductile metal powder comprising at least one metal selected from the group consisting of aluminum, copper, and titanium, and the Lunar regolith comprising a native Lunar regolith or Lunar regolith simulant.

20. The method according to claim 19, the portable cold spray system being a low pressure portable cold spray system, the step of depositing the powder mixture onto the metal substrate comprising depositing the powder mixture at an air pressure in a range of from 6 to 8 bar, an air temperature in a range of from 25° C. to 650° ° C., and a powder feed rate in a range of from 0.5 to 0.6 $gs^{-1}$, and the step of depositing the powder mixture onto the metal substrate comprising forming a coating layer with a thickness in a range of from 15 μm to 1 mm.

* * * * *